US005234393A

United States Patent [19]

Heinrich

[11] Patent Number: 5,234,393

[45] Date of Patent: Aug. 10, 1993

[54] SKIPPING APPARATUS

[76] Inventor: Carl C. Heinrich, 5 Elaine St., Bozrah, Conn. 06334

[21] Appl. No.: 947,163

[22] Filed: Sep. 18, 1992

[51] Int. Cl.[5] ..... A63B 5/20

[52] U.S. Cl. ..... 482/81; 482/82

[58] Field of Search ..... 482/81, 82, 139, 126

[56] References Cited

U.S. PATENT DOCUMENTS

| | | |
|---|---|---|
| 169,625 | 11/1875 | Crandall . |
| 3,064,972 | 11/1962 | Feinn . |
| 3,072,402 | 1/1963 | McCombs . |
| 3,074,717 | 1/1963 | Lutz . |
| 3,107,092 | 10/1963 | Morris et al. . |
| 3,118,666 | 1/1964 | Fitch . |
| 3,493,229 | 2/1970 | Ramsey . |
| 3,610,616 | 10/1971 | Evans . |
| 4,094,502 | 6/1978 | Cook . |
| 4,135,713 | 1/1979 | Martin . |
| 4,184,677 | 1/1980 | Murray . |
| 5,062,628 | 11/1991 | Heyn et al. . |

*Primary Examiner*—Richard J. Apley
*Assistant Examiner*—Lynne A. Reichard
*Attorney, Agent, or Firm*—Albert W. Hilburger

[57] ABSTRACT

Exercising apparatus is provided to enable a user to obtain twice the exercise per unit time offered by a conventional jump rope. At the same time, the apparatus of the invention provides the user with a construction as near to that of the conventional jump rope as possible. To this end, a universal connection is provided between handles held by the user and support members for a pair of hoop members over which the user jumps. The apparatus is adjustable so as to accommodate a range of sizes of users and graduated indicia is provided on the hoop members to enable a user to achieve a desired size. Also, as with a conventional jump rope, the exercising apparatus is width adjustable to the extent desired by the user. The apparatus is so constructed as to enable it to be readily assembled, then disassembled, as desired. In the disassembled condition, it occupies a minimum of space.

10 Claims, 2 Drawing Sheets

FIG. 1.
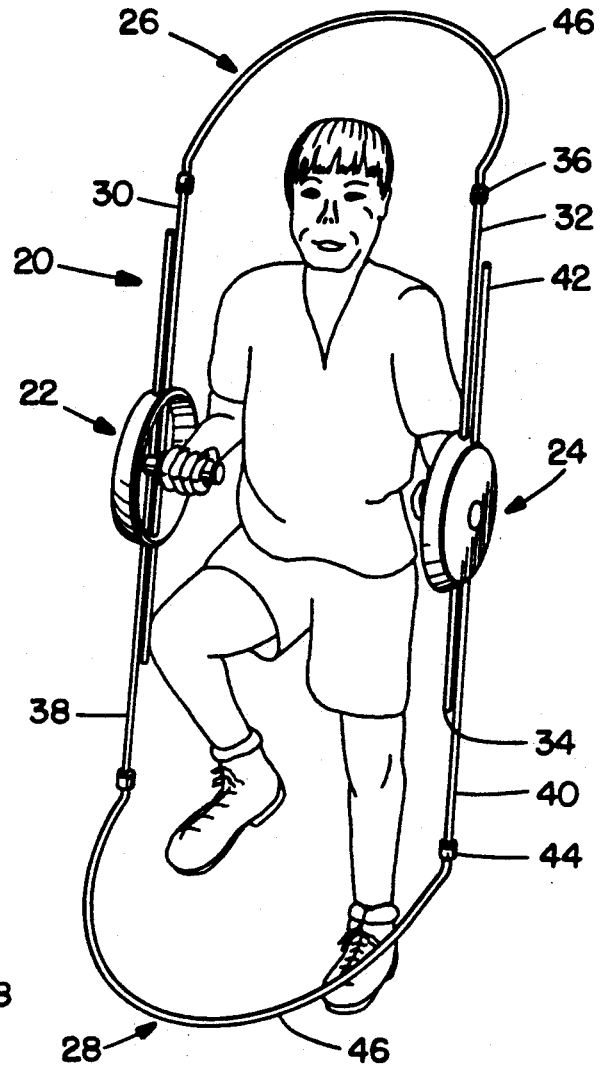
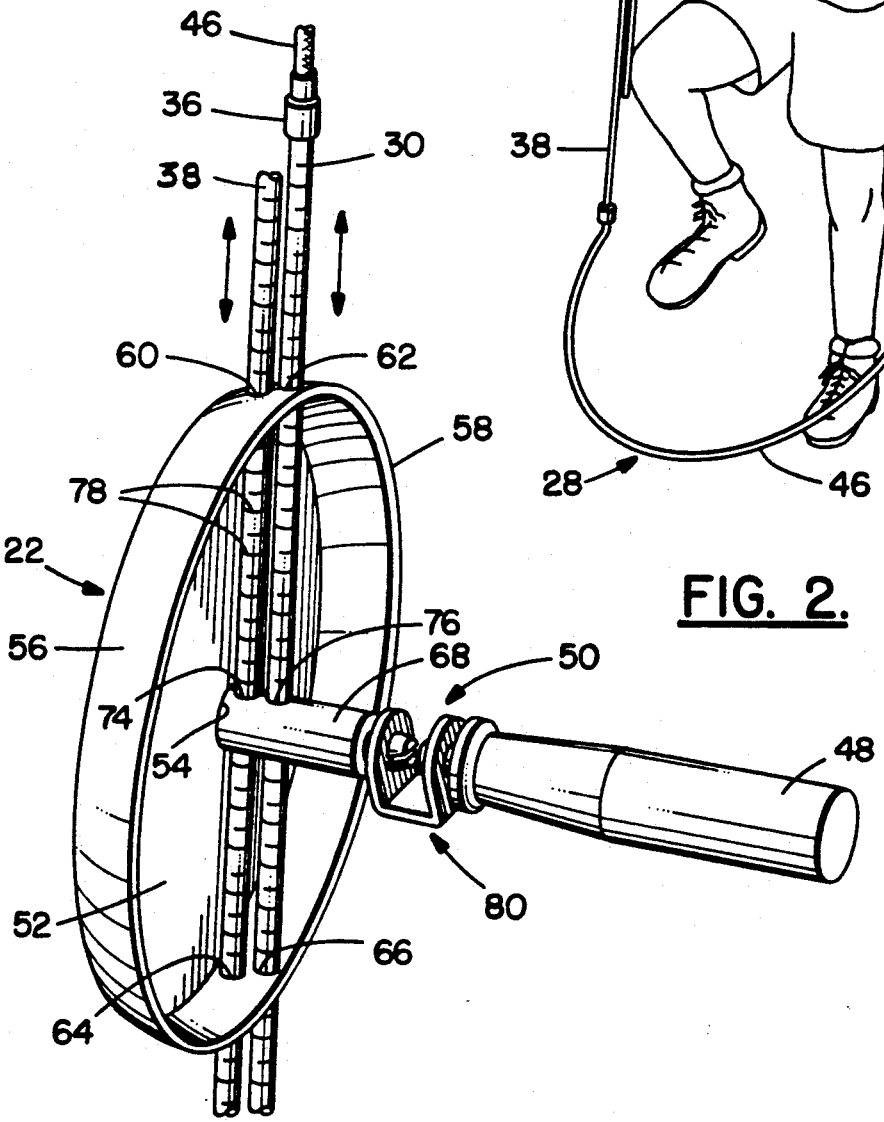
FIG. 2.

SKIPPING APPARATUS

BACKGROUND OF THE INVENTION

1. Field of the Invention

This invention relates to an exercising device, and more particularly to a jump rope apparatus that allows the rope to rotate faster than normal and aid in exercising other parts of the body in addition to the legs.

2. Description of the Prior Art

Skipping rope has long been a favorite form of entertainment for children, boys and girls alike. Rope skipping is also used as a training exercise for many athletes, such as boxers, for exercising the legs and the cardiovascular system. As is well known in the art, various types of jump rope exercises are presently being used, one being the typical jump rope that comprises an elongated section of rope having handles attached to each free end, so that the user can hold the rope and then rotate it about his body while jumping off the surface of the ground, allowing the turning rope to pass under the feet. The rope handles of this type of jump rope are generally actuated by the individual's wrist movement. More recently, attempts have been made to improve upon the exercise attained by the conventional type of jump rope by requiring the jumper to be subjected to multiple passes of the rope during the same time period previously required for one pass. These were often referred to as double jump rope or hoop constructions.

Typical of the prior art disclosing double jump rope or hoop constructions requiring the user to jump twice during a single revolution of the device are U.S. patents, U.S. Pat. No. 169,625 to Crandall; U.S. Pat. No. 3,074,717 to Lutz; U.S. Pat. No. 3,118,666 to Fitch; U.S. Pat. No. 3,493,229 to Ramsey; U.S. Pat. No. 4,135,713 to Martin; and U.S. Pat. No. 4,184,677 to Murray. In each of these instances, the hoop or rope jumping device is crank operated. In some instances, the device is height adjustable, but in all instances disclosed in these patents, the device is restricted to a fixed width.

In some other instances, double hoop or rope constructions are provided using a pair of opposed hoop-type members which revolve about and are operated by a crossbar. Representative of this type of construction are U.S. patents, U.S. Pat. No. 3,064,972 to Feinn; U.S. Pat. No. 3,072,402 to McCombs; and U.S. Pat. No. 5,062,628 to Heyn, et al. In most instances, these constructions are width limiting and, except for the McCombs patent, are height limiting as well.

In some instances, the devices are even motorized as disclosed in U.S. Pat. No. 3,107,092 to Morris, et al; and U.S. Pat. No. 3,610,616 to Evans. In the former instance, the ropes are even driven in opposite directions.

It was with knowledge of the prior art and the limitations existing in such prior art devices that the present invention has been conceived and is now reduced to practice.

SUMMARY OF THE INVENTION

The present invention, therefore, relates to exercising apparatus which is provided to enable a user to obtain twice the exercise per unit time offered by a conventional jump rope. At the same time, the apparatus of the invention provides the user with a construction as near to that of the conventional jump rope as possible. To this end, a universal connection is provided between handles held by the user and support members for a pair of hoop members over which the user jumps. The apparatus is adjustable so as to accommodate a range of sizes of users and graduated indicia is provided on the hoop members to enable a user to achieve a desired size. Also, as with a conventional jump rope, the exercising apparatus is width adjustable to the extent desired by the user. The apparatus is so constructed as to enable it to be readily assembled, then disassembled, as desired. In the disassembled condition, it occupies a minimum of space.

A principal object of this invention is to provide an improved revolving jump rope device, which provides for multiple skipping per revolution of the device balanced and stabilized in operation and may be readily manipulated and safely operated by and completely under the control of the hands of the user. Further, the inventive device is readily operable for turning and changing skipping directions and is readily usable by users of various heights and breadths. Further, the inventive device is simple and rugged in construction, is inexpensive to manufacture and easy to assemble, utilizes commonly available materials in its construction, has utility in gymnasiums and the like for body building and exercising programs, and is pleasurable to use by children and also by adults. Yet an additional feature of the invention is its novel construction which enables it to be readily disassembled for storage or for travel and, thereafter, enables it to be readily and easily reassembled for use.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

BRIEF DESCRIPTION OF THE DRAWINGS

FIG. 1 is a perspective view of a person using exercising apparatus of the double jump type and embodying the present invention;

FIG. 2 is a detail perspective view illustrating part of the apparatus illustrated in FIG. 1;

DETAILED DESCRIPTION OF THE PREFERRED EMBODIMENT

Figure 3:
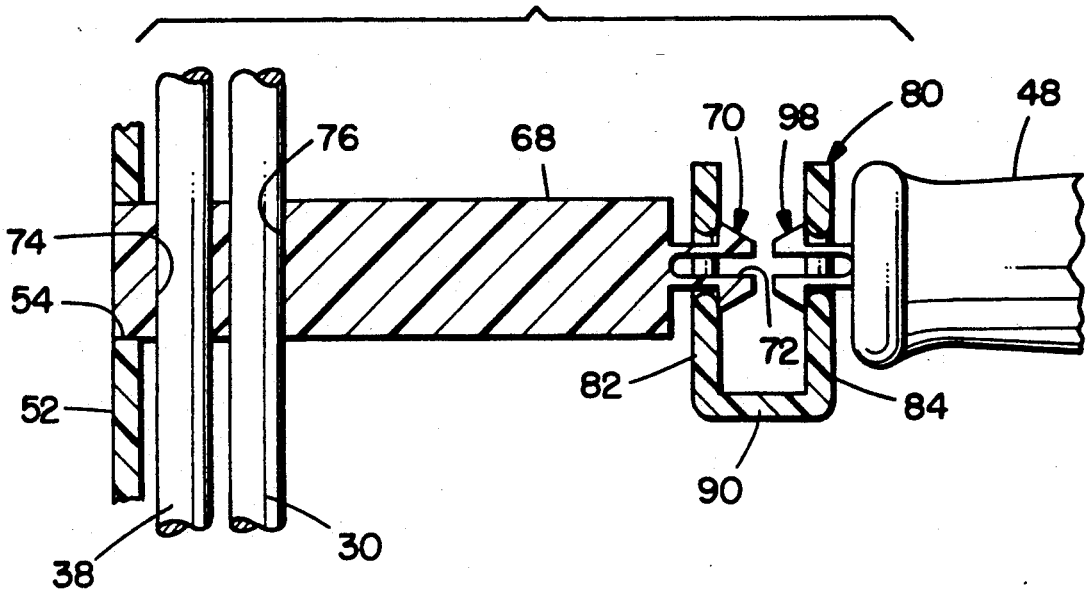
FIG. 3 is a detail side elevation view, certain parts being shown in section for clarity, of a part of FIG. 2.

Turn now to the drawings and, initially, to FIG. 1 which generally illustrates the use of exercising apparatus 20 which embodies the present invention. As depicted in FIG. 1, opposed support mechanisms 22, 24 are positioned on opposite sides of the user and held by the user in a manner to be described. A first hoop construction 26 includes a pair of parallel, spaced apart leg members 30, 32 which extend, respectively, between inner and outer terminal ends 34, 36.

In a similar fashion, the second hoop construction includes third and fourth parallel, spaced apart, leg members 38, 40 which extend, respectively, between inner and outer terminal ends 42, 44, respectively. The leg members may be composed of wood dowelling or other suitable moderately flexible lightweight material which can be readily fabricated into elongated, small diameter, members generally as indicated.

Suitable lengths of flexible elongated cord or rope 46 is attached to the outer terminal ends 36 of the leg members 30, 32 and likewise to the outer terminal ends 44 of the leg members 38, 40. It is preferred that the cord 46 does not extend in a taut manner between its respective leg members. Rather, it is desirable for the cord 46 to form a loop generally simulating a conventional jump rope over which the user is supposed to jump. A pair of handles 48 (See FIG. 2) intended to be gripped by the user are associated with each of the support mechanisms 22, 24. The handles 48 are connected to the support mechanisms 22, 24 by means of a universal joint 50 enabling freedom of movement of each handle relative to its associated support mechanism about all three axes of movement. By reason of the fact that the handles 48 associated with the support mechanisms 22, 24 are independent of one another and are universally connected to the support mechanisms, the exercising apparatus 20 of the invention has a "feel" as close to that of a conventional jump rope as possible while incorporating all of the features not found in conventional jump rope devices.

The support mechanisms 22, 24 will now be described with particular reference to FIGS. 2 and 3. It will be appreciated that the two support mechanisms are identical such that a description of support mechanism 22 is also appropriate for support mechanism 24.

Support mechanism 22 includes a generally circular plate member 52 formed with a central aperture 54. A peripheral flange 56 is integral with plate 52 and extends transversely from the plate to an outer rim 58. A pair of spaced holes 60, 62 are formed in the peripheral flange 56 at a predetermined azimuthal position. A second pair of spaced apart holes, 64, 66 are similarly formed in the peripheral flange 56 generally aligned at an azimuthal position which is diametrically opposed to the holes 60, 62, respectively.

An elongated hub member 68 may be generally cylindrical, having one end fittingly received in the central aperture 54 of the plate member 52. The hub member extends along an axis which is generally perpendicular to a plane of the plate member 52 to a releasable fastener 70. The hub member 68 and, in particular, the fastener 70 which may be bifurcated by reason of a slot 72 is preferably composed of a resilient material for a purpose to be described below. A pair of bores 74, 76 extend transversely through the hub member 68 adjacent the end received in the central aperture 54. The bores 74, 76 are of a size to fittingly receive the leg members 30, 38. Viewing especially FIG. 2, it will be appreciated that the bores 74, 76 are generally aligned with the bores 60, 64 and 62, 66, respectively.

Because of the fitting relationship between the leg members, the peripheral flange 56, and the hub member 68, the leg members can be moved to a desired axial position relative to the support mechanisms 22, 24 and retained at that position by reason of the frictional engagement among the parts until the user makes a change to another relative position. Thus, a user may desire to adjust the first and second hoop constructions 26, 28 relative to the support mechanisms 22, 24 to accommodate his or her height. Appropriate markings 78 may be provided on the leg members at regularly spaced locations to serve as indicia for predetermined locations on each of the leg members. The markings would be identical on each of the leg members 30, 32, 38, and 40 so that a user could know, for example, a particular relationship between the markings 78 and the flange 56 which provide a size of the apparatus 20 most desirable for his or her use of it.

It was previously mentioned that the handles of 48 are universally joined to the support mechanisms 22, 24. The construction of the invention which enables such a construction will now be described.

Figure 4:
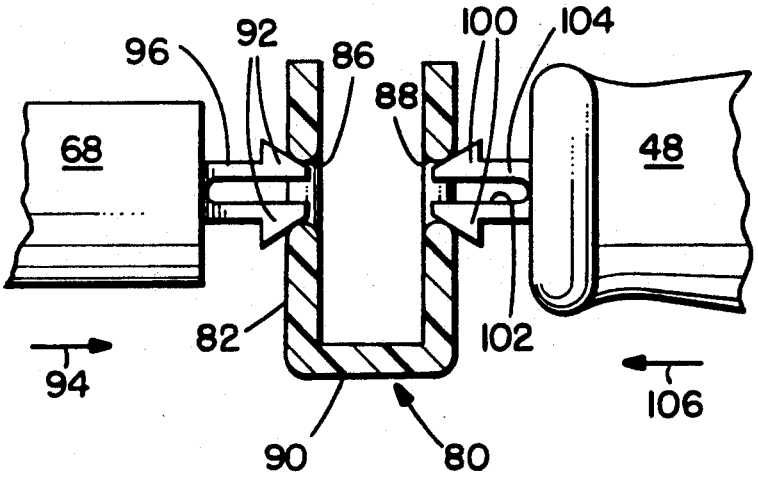
FIG. 4 is a detail side elevation view, certain parts being shown in section for clarity, illustrating another relative position of parts illustrated in FIG. 3.

One form of the universal joint 50 may be that which is best depicted in FIGS. 3 and 4. As seen in those figures, a clevis 80 is provided between each handle 48 and its associated hub member 68. The clevis 80 has a pair of opposed parallel ear members 82, 84 with aligned holes 86, 88 therethrough and a bight member 90 joining the ear members. To attach the clevis 80 to the hub member 68, opposed cam teeth 92 of the fastener 70 are moved into engagement with the hole 86. With particular attention to FIG. 4, further movement of the hub member 68 in the direction of an arrow 94, relative to the clevis 80, will cause the opposed teeth 92 to diminish diametrically in size until they pass entirely through the ear member 82. In this condition, the ear member 82 is loosely positioned between the cam teeth 92 and the main body of the hub member 68. A connector 96 of the fastener 70 is of a width substantially greater than that of the ear member 82 and of a diameter substantially smaller than that of the hole 86. This construction allows substantial relative movement between the clevis 80 and the hub member 68.

In a similar manner, a fastener 98 is provided at an end of the handle 48. It has opposed cam teeth 100 with a slot 102 between them and a connector 104, all of which are of a shape and size similar to those parts of the fastener 70. As with the hub member 68, when the handle 48 is moved in the direction of an arrow 106, the cam teeth 100 pass through the hole 88 until the condition illustrated in FIG. 3 is achieved.

In this manner, an exceedingly loose, yet locked construction is provided between the handles 48 and the associated support mechanisms 22, 24. The handles 48, clevises 80, and hub members 68 can be mutually disengaged by pressing the cam teeth 92 and 100 together, then withdrawing them through their associated holes 86, 88 in the clevis 80. In the same manner, the leg members can be drawn through their associated holes in the peripheral flange 56 and through their associated bores in the hub member 68. After that has been accomplished, the hub member 68 can then be readily removed from the central aperture 54. In this manner, it can be seen that the apparatus 20 can be readily disassembled and then, again, just as readily re-assembled.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. Exercising apparatus comprising:

hoop means including first and second opposed leg members and first and second integral transverse members at opposite ends thereof over which a user can jump;

first support means mounted to said first leg members intermediate said transverse members;

second support means mounted to said second leg members intermediate said transverse members;

first and second opposed, mutually independent, elongated handle means having generally aligned longitudinal axes for imparting rotation by the user of said hoop means about a transverse axis extending generally through said handle means;

first universal joint means connecting said first handle means to said first support means to enable relative movement between said first handle means and said first support means about at least two axes; and second universal joint means connecting said second handle means to said second support means to enable relative movement between said second handle means and said second support means about at least two axes.

2. Exercising apparatus as set forth in claim 1 wherein said transverse members include flexible elongated cords extending between and attached to said first and second leg members, respectively.

3. Exercising apparatus as set forth in claim 1 wherein said first and second support means includes means for adjustably mounting said first and second leg members thereto.

4. Exercising apparatus as set forth in claim 3 wherein said first and second leg members include markings thereon at a plurality of regularly spaced locations for indicating the position thereof in relation to said first and second support means.

5. Exercising apparatus as set forth in claim 1 wherein said hoop means includes:

a first hoop member including first and second opposed leg members, each of said first and second leg members having inboard and outboard ends; and a flexible transverse cord connected at its opposite ends, respectively, to said outboard ends of said first and second leg members; and a second hoop member including third and fourth opposed leg members, each of said third and fourth leg members having inboard and outboard ends; and a flexible transverse cord connected at its opposite ends, respectively, to said outboard ends of said third and fourth leg members.

6. Exercising apparatus comprising:

first hoop means including first and second parallel spaced apart leg members extending between inner and outer terminal ends;

second hoop means including third and fourth parallel spaced apart leg members extending between inner and outer terminal ends;

first support means for engageably receiving said first leg member of said first hoop means and said third leg member of said second hoop means proximate said inner terminal ends thereof;

second support means for engageably receiving said second leg member of said first hoop means and said fourth leg member of said second hoop means proximate said inner terminal ends thereof;

first and second opposed, mutually independent, elongated handle means having generally aligned longitudinal axes for imparting rotation by the user of said first and second hoop means about a transverse axis extending through said first and second support means;

first universal joint means connecting said first handle means to said first support means to enable relative movement between said first handle means and said first support means about at least two axes; and second universal joint means connecting said second handle means to said second support means to enable relative movement between said second handle means and said second support means about at least two axes.

7. Exercising apparatus as set forth in claim 6 wherein said first hoop means includes:

a flexible elongated cord extending between and attached to said outer ends of said first and second leg members; and a flexible elongated cord extending between and attached to said outer ends of said third and fourth leg members.

8. Exercising apparatus as set forth in claim 6 wherein said first support means includes:

a first plate member having a central aperture therethrough;

a peripheral flange integral with said first plate member and extending transversely therefrom to an outer rim and having a first pair of spaced apart holes in said flange generally aligned at a predetermined azimuthal position and a second pair of spaced apart holes in said flange generally aligned at an azimuthal position diametrically opposed to the first pair of holes; and an elongated hub member having one end fittingly received in the central aperture of said first plate member and extending transversely therefrom to a releasable fastener and having a pair of bores therethrough generally aligned with the first and second pairs of holes in said flange;

said first leg members of said first and second hoop means being engageably received through the first and second pairs of spaced apart holes in said flange and through the bores in said hub member; and wherein said second support means includes:

a second plate member having a central aperture therethrough;

a peripheral flange integral with said second plate member and extending transversely therefrom to an outer rim and having a first pair of spaced apart holes in said flange generally aligned at a predetermined azimuthal position and a second pair of spaced apart holes in said flange generally aligned at an azimuthal position diametrically opposed to the first pair of holes; and an elongated hub member having one end fittingly received in the central aperture of said second plate member and extending transversely therefrom to a releasable fastener and having a pair of bores therethrough generally aligned with the first and second pairs of holes in said flange;

said second leg members of said first and second hoop means being engageably received through the first and second pairs of spaced apart holes in said flange and through the bores in said hub member.

9. Exercising apparatus as set forth in claim 8 wherein said first and second leg members of said first and second hoop members include markings thereon at a plurality of regularly spaced locations for indicating the position thereof in relation to said first and second support means.

10. Exercising apparatus as set forth in claim 8 wherein said first handle means includes a gripping member and a releasable fastener thereon; and wherein said first universal joint means includes a substantially rigid clevis member including a pair of opposed parallel ear members having a aligned holes therethrough and a bight member joining said ear members;

wherein said releasable fastener of said first handle means is loosely engaged with one of said ear members of said clevis member; and wherein said releasable fastener of said hub member of said first support means is loosely engaged with the other of said ear members of said clevis member; and wherein said second handle means includes a gripping member and a releasable fastener thereon; and wherein said second universal joint means includes a substantially rigid clevis member including a pair of opposed parallel ear members having aligned holes therethrough and a bight member joining said ear members;

wherein said releasable fastener of said second handle means is loosely engaged with one of said ear members of said clevis member; and wherein said releasable fastener of said hub member of said second support means is loosely engaged with the other of said ear members of said clevis member.

* * * * *